US010553353B2

(12) United States Patent
Vanukuru

(10) Patent No.: US 10,553,353 B2
(45) Date of Patent: Feb. 4, 2020

(54) PARALLEL STACKED INDUCTOR FOR HIGH-Q AND HIGH CURRENT HANDLING AND METHOD OF MAKING THE SAME

(71) Applicant: GLOBALFOUNDRIES Inc., Grand Cayman (KY)

(72) Inventor: Venkata N. R. Vanukuru, Bangalore (IN)

(73) Assignee: GLOBALFOUNDRIES INC., Grand Cayman (KY)

( * ) Notice: Subject to any disclaimer, the term of this patent is extended or adjusted under 35 U.S.C. 154(b) by 0 days.

(21) Appl. No.: 15/355,584

(22) Filed: Nov. 18, 2016

(65) Prior Publication Data

US 2018/0144857 A1 May 24, 2018

(51) Int. Cl.
*H01F 5/00* (2006.01)
*H01F 41/04* (2006.01)
*H01F 17/00* (2006.01)

(52) U.S. Cl.
CPC ..... *H01F 41/041* (2013.01); *H01F 5/00* (2013.01); *H01F 17/0013* (2013.01); *H01F 2017/0046* (2013.01)

(58) Field of Classification Search
CPC ..... H01F 5/00; H01F 27/00–27/36
USPC ..... 336/65, 180–184, 192, 200, 232
See application file for complete search history.

(56) References Cited

U.S. PATENT DOCUMENTS 4,956,626 A * 9/1990 Hoppe ..... H01F 27/085 165/179
5,831,331 A * 11/1998 Lee ..... H01L 23/645 257/659
6,002,161 A * 12/1999 Yamazaki ..... H01L 23/645 257/531
6,031,445 A 2/2000 Marty et al.
7,064,411 B2 * 6/2006 Hashizume ..... H01F 17/0006 257/516
7,592,891 B2 9/2009 Hsu et al.
9,449,753 B2 * 9/2016 Kim ..... H01F 27/2804
2011/0133875 A1 * 6/2011 Chiu ..... H01F 17/0013 336/200

* cited by examiner

*Primary Examiner* — Tuyen T Nguyen
(74) *Attorney, Agent, or Firm* — Todd A. Bayne, Jr.; DeLio Peterson & Curcio LLC

(57) ABSTRACT

A high performance, on-chip a parallel stacked inductor which achieves a higher Q value. The inductor is formed on a layered substrate with a top metal layer having spiral winding conductive segments that terminate at an overpass junction, and a bottom metal layer traversing adjacent to, and parallel with, the top metal layer. The bottom metal layer having multiple bar vias imbedded therein for current carrying capabilities. The overpass junction having a width that is greater than the width of the adjacent spiral winding conductive segments.

12 Claims, 6 Drawing Sheets

PARALLEL STACKED INDUCTOR FOR HIGH-Q AND HIGH CURRENT HANDLING AND METHOD OF MAKING THE SAME

BACKGROUND OF THE INVENTION

1. Field of the Invention

The present invention relates to a high performance, on-chip inductor typically utilized in RF circuits. In particular, the present invention relates to an improved on-chip inductor, and methods of making the same. Specifically, the inductor is a parallel stacked structure which achieves a higher Q value for the same inductance density and current handling of presently employed on-chip inductors.

2. Description of Related Art

Many structures have been proposed for the manufacture of inductors in integrated circuits. These structures comprise a planar, spiral arrangement of conductive track, arranged in a plane parallel to the semiconductor substrate.

Inductors in particular are critical components in oscillators, power amplifiers and other tuned circuits. For low-frequency applications, passive devices can be connected externally, but as the frequency increases, the characteristics of the passive devices would be overwhelmed by parasitic effects.

Basically there are three shapes of on-chip spiral inductors. They are square, octagonal and circular. Although a circular shaped inductor may be more efficient from a Q standpoint, the shape of inductor is often limited to the availability of fabrication processes. Most processes restrict all spiral angles to be 90° or 45°, and octagonal/square patterns are a natural choice. Structural parameters such as the outer dimension, number of turns, the distance between the centers of lines (or pitch), and substrate property are all important factors in determining the performance of on-chip inductors.

While microelectronic inductor structures are thus desirable and often essential within the art of microelectronic fabrication, microelectronic inductor structures are nonetheless not entirely without problems in the art of microelectronic fabrication. In that regard, it is typically desirable in the art of microelectronic fabrication, but nonetheless not always readily achievable, to fabricate microelectronic devices having formed therein microelectronic inductor structures with optimal properties, as characterized by enhanced Q values of the microelectronic inductor structures. (High-Q inductors are utilized in many electronic devices, such as TV turners, RF chokes, low noise amplifiers, voltage controlled oscillators, and power amplifiers, to name a few.)

The quality factor Q is an extremely important figure of merit for an inductor at high frequencies. For an inductor, only the energy stored in the magnetic field is of interest. Basically, it describes how good an inductor can work as an energy-storage element. In the ideal case, inductance is a pure energy storage element (Q approaches infinity), while in reality parasitic resistance and capacitance reduce Q. This is because the parasitic resistance consumes stored energy, and the parasitic capacitance reduces inductivity (the inductor can even become capacitive at high frequencies). Self-resonant frequency $f_{SR}$ marks the point where the inductor turns to capacitive and, obviously, the larger the parasitic capacitance, the lower the $f_{SR}$.

On-chip inductors are key passive components in radio frequency/millimeter wave integrated circuits. In the design of semiconductor device radio frequency integrated circuits, inductors are very important devices to be considered. It has been shown that along with the miniaturization of devices, the traditional planar type of inductor, which occupies a large area, fails to conform to current demands. Moreover, conflicting requirements exist in on-chip inductor designs. For example, current handling of the inductor increases with width and thickness of the inductor line segments; however, Q decreases with width and thickness due to the increased proximity effect.

On-chip inductors are used in RF microelectronic devices for eliminating impedance mismatching, minimizing reflection and losses, securing required resonance frequencies, and cutting AC currents such as high frequency comparisons in power supply lines, among other uses. RF coils (inductors) are usually wound on a single layer. An RF inductor reduces proximity effects and parasitic capacitance. RF inductors generally have windings that are wound on a single layer, with turns spaced apart.

In U.S. Pat. No. 7,592,891, issued to Hsu, et al. on Sep. 22, 2009 titled "PLANAR SPIRAL INDUCTOR STRUCTURE HAVING ENHANCED Q VALUE," a planar spiral conductor layer is formed over a substrate, establishing a planar spiral inductor, wherein a successive series of spirals within the planar spiral conductor layer are formed with a variation in: (1) a series of line widths of the successive series of spirals; and, (2) a series of spacings of the successive series of spirals.

SUMMARY OF EMBODIMENTS OF THE INVENTION

It is desirable to design and fabricate on-chip inductors with characteristics of small size, high quality factor (Q factor), large inductance, and high self-resonating frequency that are improved from known devices in the art. It is important to make on-chip inductors consume as little real estate as possible to mitigate large parasitic capacitance between the on-chip inductor and the substrate in order to reduce unwanted noise. It is also desirable to introduce an on-chip inductor that achieves a higher Q value for the inductance density and current handling of present RF on-chip inductors.

Bearing in mind the problems and deficiencies of the prior art, it is therefore an object of the present invention to provide a high efficiency inductor for integrated circuit applications that minimizes the footprint associated with the inductor layout on the substrate.

It is another object of the present invention to provide a parallel stacked inductor structure which achieves a higher Q value for typical values of inductance density and current handling.

The above and other objects are achieved in the present invention, which is directed at a parallel stacked inductor for an integrated circuit, the inductor comprising a plurality of metal layers having a plurality conductive spiral winding segments thereon, wherein the width and/or thickness of spiral winding segments on a top metal layer and/or spiral winding segments of a bottom metal layer are increased only at locations where the respective spiral winding segments are broken for overpass or underpass connections, respectively.

The spiral winding segments may comprise multiple layer of parallel stacked conductive path segments. Adjacent spiral winding segments of a top metal layer may be joined using underpass and overpass connections without electrically shorting to respective conductive path segments.

The bottom metal layer may include multiple spiral segment bar vias for higher Q and current carrying.

The underpass and/or overpass connections are configured to have a width wider than the spiral winding segments.

The bottom metal layer may include wider track widths than the top metal layer with overpass configuration and vice versa with underpass configuration to reduce series losses and increase current handling.

Multiple spiral winding segments of top and bottom spirals can be interconnected in such a way that their electrical path lengths are approximately equal.

The outermost spiral winding segments of a given spiral turn may be electrically connected to innermost spiral winding segments of a subsequent spiral turn.

The top or bottom metal layers comprise a continuous conductive path while the other spiral is broken for underpass/overpass connection.

One or more lower metal layers of the plurality of metal layers can be used to selectively connect to the lower spiral of the parallel stacked inductor for further improved current handling, including having an increased thickness and/or width as compared to the top metal layer. The increased thickness and/or width is localized along the at least one lower metal layer of the plurality of metal layers such that a gradual decrease in the thickness and/or width is formed along at least one turn of the spiral winding segments.

A thermal dissipation mechanism may be employed within or adjacent to at least one of the spiral winding segments.

In a second aspect, the present invention is directed to a method of forming a parallel stacked inductor for an integrated circuit, comprising: providing a substrate; forming an upper metal layer on the substrate having a plurality of conductive segments having a width and winding in an approximate spiral-shaped pattern, with outer conductive segments adjacent to inward conductive segments; forming an overpass junction at termination points of the plurality of conductive segments, the overpass junction having a width greater than the conductive segments width; and forming a bottom metal layer parallel to, and underneath, the upper metal layer, the bottom metal layer being a continuous conductive path having a width and winding in an approximate spiral-shaped pattern, and including multiple bar vias traversing the continuous conductive path.

The plurality of conductive segments of the upper metal layer are equidistant from one another. The overpass junction at each segment electrically connects an outermost path of one spiral turn with an innermost path of a next spiral turn, allowing for equal current path length over the course of the spiral winding.

An arbitrary number of spiral turns may be employed, wherein a number of bends at an $i^{th}$ spiral turn is equal to (i−1) if all protrusions are inwards, and equal to (i−2) if an outermost turn protrudes outwards for i>2.

The bottom metal layer may be tailored for high current handling, including increasing a thickness and/or width of the bottom metal layer as compared to the top metal layer.

An increased thickness and/or width along the bottom metal layer may be utilized such that a gradual decrease in the thickness and/or width is formed along at least one of the plurality of conductive segments.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

A substrate is a solid (usually planar) layer of substance onto which a layer of another substance is applied, and to which that second substance adheres. In some instances, a substrate can be a semi-conductive material, an electrical insulator, or some combination thereof. Different types of substrates can be used for different types of fabrication process. Many integrated circuits (ICs) are fabricated onto multilayered substrates that include at least a layer of semi-conductive material. Individual electronic devices can be fabricated (e.g., etched, deposited, or otherwise formed) onto the wafers (e.g., via a photolithography process), including such on-chip devices as resistors, capacitors, inductors, and transformers.

Inductors are essentially coils which generate a magnetic field that interacts with the coil itself, to induce a back electromagnetic field (EMF) which opposes changes in current through the coil. Inductors are used as circuit elements in electrical circuits to temporarily store energy or resist changes in current. An inductor is characterized by its inductance (L), the ratio of the voltage to the rate of change of current, and which has units of Henries (H). Inductance (L) results from the magnetic field around a current-carrying conductor, insomuch as the electric current through the conductor creates a magnetic flux. Inductance is determined by how much magnetic flux through the circuit is created by a given current.

Current technology improvements and advancements has required the need for inductors to be used on and within substrates, using planar device fabrication techniques.

Figure 1:
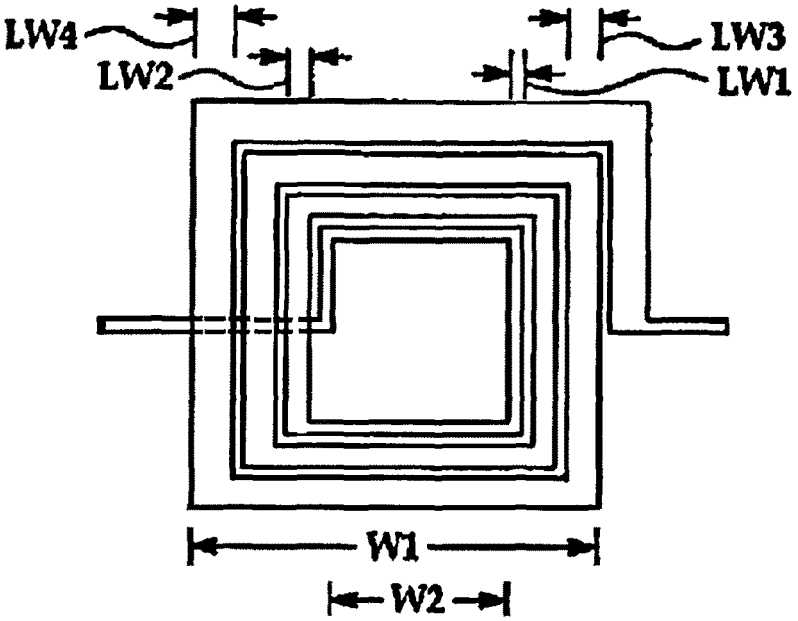
FIG. 1 PRIOR ART
FIG. 1 depicts a prior art inductor having variable width.

FIG. 1 depicts the Hsu prior art inductor having variable width. Hsu teaches a spirally patterned conductor layer which comprises a successive series of spirals, and where the planar spiral conductor layer is formed with a variation of at least one of: (1) a series of line widths of the successive series of spirals; and (2) a series of spacings which separate the successive series of spirals, within the spirally patterned conductor layer. In Hsu, the width of the spiral segments is designed to be variable.

In another attempt to vary the peak-Q frequency, some designs will also electrically connect the stacked layers with selectively placed metal shunts, such as the selective metal shunting taught in IEEE TCAS-1, September 2005.

Figure 2A:
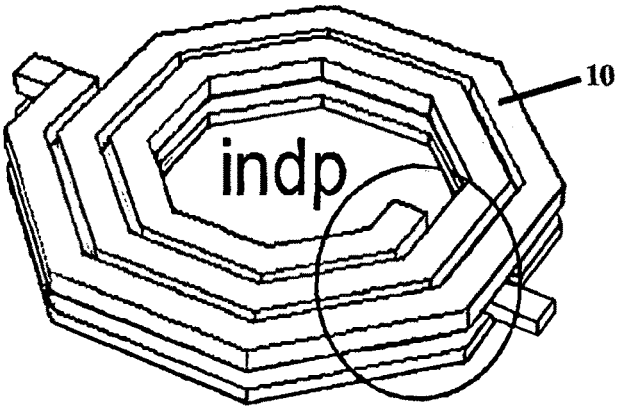
FIG. 2A PRIOR ART
FIG. 2A depicts a perspective view of a prior art parallel stacked on-chip inductor having a top metal layer that spirals towards the center with broken secondary for underpass connection.
Figure 2B:
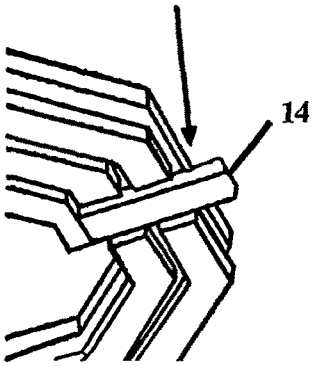
FIG. 2B PRIOR ART
FIG. 2B depicts the bottom metal layer of FIG. 2A, which includes an underpass where the bottom metal spiral segments separate.

FIG. 2A depicts a perspective view of a prior art parallel stacked on-chip inductor having a top metal layer 10 that spirals towards the center with a broken secondary for underpass connection. In this type of inductor design, the current handling capabilities are still not increased because the two spirals are separated at the locations where underpass connection is made. This is required to prevent the spiral turns from shorting each other. In this design, two spiral metal layers overlap one another. As depicted in FIG. 2B, the bottom metal layer 12 includes an underpass 14 where the bottom metal spiral segments separate.

High current designs like power amplifiers demand usage of extremely wide spiral tracks to prevent issues like electromigration. However, wider spiral tracks necessarily lead to higher eddy current loses (which are proportional to the width of the spiral segments). This is detrimental to the resistance and the quality factor. A favored design would be where the Q-value increases as the resistance decreases, thus accommodating increased current capability.

The resistance and critical frequency for spiral inductors are expressed as follows:

$$R(f) = R_{DC}\left[1 + \frac{1}{10}\left(\frac{f}{f_{crit}}\right)^2\right]$$

$$f_{crit} = \frac{3.1}{2\pi\mu_0}\left(\frac{P}{W^2}\right)R_{sh} \approx \frac{3.1}{2\pi\mu_0}\left(\frac{R_{sh}}{W}\right)(W >> S)$$

where,

R(f)=the resistance as a function of frequency (Ω);

$R_{sh}$=sheet resistance (Ω/sq);

W=width (μm);

S=spacing between turns (μm); and

P=pitch=W+S (μm)

Figure 3:
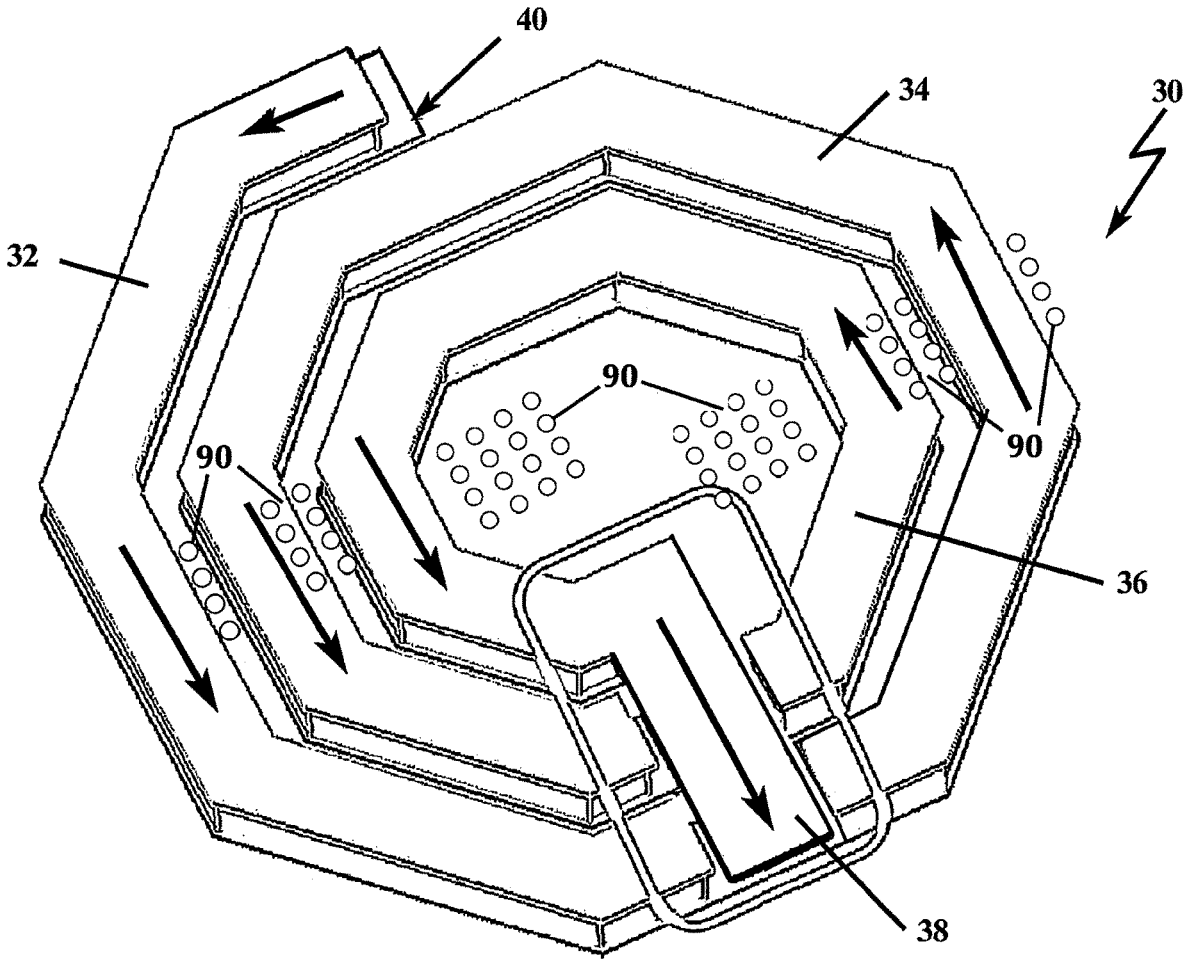
FIG. 3 depicts a layout, perspective view of at least one embodiment of the present invention where the top spiral is broken for overpass connection and the bottom spiral is continuous.
Figure 4:
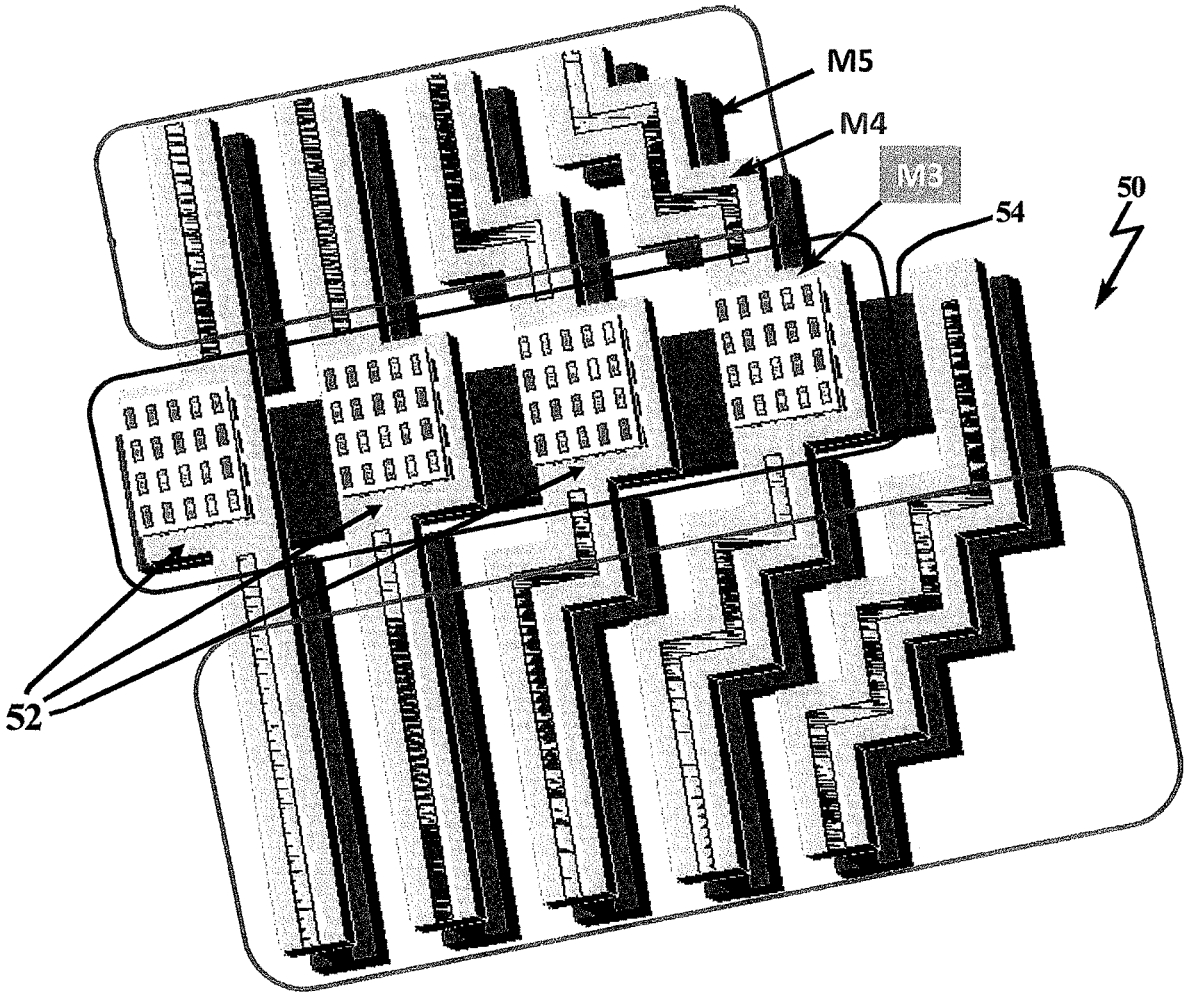
FIG. 4 depicts a perspective view of a 5-turn inductor having metal layers M5, M4, and M3 where M3 (or several lower metal layers) can be selectively added to the M4 spiral.

FIG. 3 depicts a layout, perspective view of at least one embodiment of the present invention where the top spiral is broken for overpass connection and the bottom spiral is continuous. FIGS. 3 and 4 disclose a parallel stacked inductor where the top metal spiral (M5) is broken to facilitate overpass connection with the bottom spiral (M4) being continuous. This configuration helps judicious usage of lower metals (M3/M2/M1) to be added to the bottom spiral (M4) at the locations where M4 and M5 are not stacked together for overpass connection. As noted in the accompanying figures, an octagonal shape is demonstrated; however, the present invention may be applied to any number of shapes—that is, a spiraling inductor having a plurality of bends.

FIGS. 3 and 4 show the locations where the top (M5) and bottom (M4) spirals are disjointed for an exemplary 5 turn inductor, where the top spiral is broken for overpass connection and the bottom spiral is continuous. To allow lateral widening of the bottom spiral (M4) in both the directions, protrusions are by a spiral turn into its neighboring spirals. These protrusions from a give spiral turn are carried forward to the other spirals till the outermost/innermost turns are presented. In a preferred embodiment, an identification of the number of protrusions may be expressed as follows:

=($i$−1) if all the protrusions are inwards; and

=($i$−2) if the outermost turn protrudes outwards (for $i$>2).

The metal line octahedral segments are preferably aluminum and/or copper in composition, although other conductive materials may be utilized, combined, or incorporated. As noted in FIG. 3, there is a break in the top layer octahedral line segments 32, 34, and 36, where an overpass segment 38 traverses. Overpass segment 38 is designed with a width that is larger than any of the octahedral line segment widths. This allows overpass 38 to accommodate higher current. In this figure, the underneath (or bottom layer) spiral 40 is continuous, while the top level spiral is broken to accommodate the overpass segment 38. Other than overpass segment 38, top metal line segments 32-36 and bottom metal line 40 share current. An advantage of this design is that several lower metal lines may be added in parallel to share even more current. Parallel stacking is performed by this design, insomuch as each layer is designed to carry about the same current in the same direction. The overpass segment 38 may be designed to be the same width as the spiral lines, or designed to be wider than the spiral lines, and in either case, the multiple stacked design would still handle the extra current.

FIG. 4 depicts a perspective view of a portion of a 5-turn inductor 50 having metal layers M5, M4, and M3. In this embodiment, the M4 layer, representing the outermost turn, "bulges" 52 in width at the locations where the M5 layer segments are broken and underpass 54 is presented. These "bulges" or width-expanding segments 52 add localized connection to the stacked M3 layer. By increasing the width of the M4 layer at "bulge" 52 locally, the current carrying capabilities at the junction are enhanced.

Figure 5A:
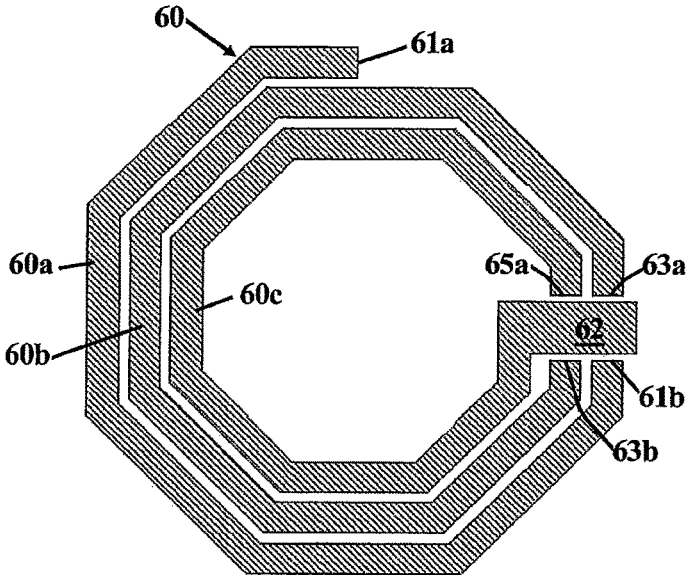
FIG. 5A depicts a layout view of a top metal layer of an embodiment of the stacked parallel inductor of the present invention.

FIG. 5A depicts a layout view of a top metal layer 60 of an embodiment of the stacked parallel inductor of the present invention. In this embodiment, spiral segments 60*a*, 60*b*, and 60*c* terminate at overpass 62. Preferably, the spiral width is on the order of 10-12 microns, while the overpass 62 width is significantly wider, which in this example is on the order of 20 microns. Octahedral segment 60*a* starts at open end 61*a* and ends before overpass 62 at termination point or open end 61*b*. It forms the outermost current carrying segment of the spiral inductor. Octahedral segment 60*b* starts at overpass 62 at termination point or open end 63*a*, extending the current carrying segment 60*a*, traversing parallel to segment 60*a*, spiraling inwardly closer to the center of the spiral inductor, and ending at termination point or open end 63*b*, which is adjacent to, and inward from, termination point 61*b*. Octahedral segment 60*c* commences adjacent overpass 62, extending the current carrying segment 60*b*, starting at termination point or open end 65*a*, and spiraling inwardly closer to the center of the spiral inductor ending at overpass 62.

Figure 5B:
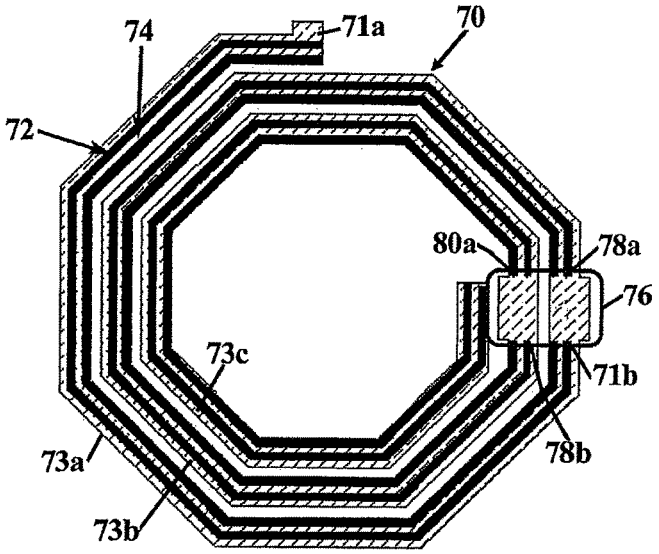
FIG. 5B depicts a layout view of the bottom metal layer of the disclosed parallel stacked inductor design of FIG. 5A, along with the BAR vias that connect the two spiral all along their length.

FIG. 5B depicts a layout view of the bottom metal layer 70 of the disclosed parallel stacked inductor design, along with the BAR vias that connect the two spiral lines along their respective length. In this embodiment, bottom metal layer 70 includes dual (can be one or more in general) spiral segment bar vias 72, 74 which, like the top metal layer, are broken into segments as they traverse the octahedral bottom metal layer 70 around a spiral. BAR vias are used to connect the top and bottom spirals which can support lateral current conduction thereby increasing the effective thickness of the composite spiral which in turns reduces resistance. Octahedral bar via segments 72, 74 start at open end 71*a* of octahedral segment 73*a* and first terminate before junction 76 at end point 71*b*. Together, the bar via segments form the outermost current carrying segment of the bottom metal layer 70 of the spiral inductor. Octahedral segment 73*b* starts at junction 76, at end point 78*a*, extending the current carrying segment 73*a*, and traverses parallel to segment 73*a* spiraling inwardly closer to the center of the spiral inductor, ending at termination or end point 78*b*, which is adjacent to, and inward from, termination point 71*b*. Octahedral segment 73*c* commences adjacent junction 76, at end point 80*a*, extending the current carrying segment 73*b*, and spiraling inwardly closer to the center of the spiral inductor ending adjacent junction 76.

Junction 76 is designed to extend the width of bottom metal layer 70 at these current cross-over locations. Junction 76 is a wider section of bottom metal layer 70.

Each conductor segment is approximately the same width as the next segment (except at the junction and overpass locations), which promotes consistent inductance and impedance transformation. Furthermore, the cross-over connections may attach segmented portions at different layers of a multiple layered substrate. These segments carry the same current in the same direction, and are configured for parallel stacking.

In preferred instances, in the case of parallel stacking, when one of the spiral segments is broken, an overpass/underpass connection is provided to complete the primary or secondary winding. The overpass/underpass segments enjoy a great width than their adjoining metal line segments.

Independent of the overpass/underpass design, several modifications may be made to the windings to enhance performance. In another embodiment, the top section of the spiral segments may also be designed with gradually decreasing width and increasing spacing from the outermost turn to the innermost turn to mitigate series losses.

Additionally, the bottom section may also have wider track widths than the top section to reduce series losses and increase current handling.

In one embodiment these multiple segments are interconnected in such a way that their path lengths may be equal. For example the outermost segment of a given spiral turn may be connected to the innermost segment of the subsequent spiral turn, etc.

Figure 6:
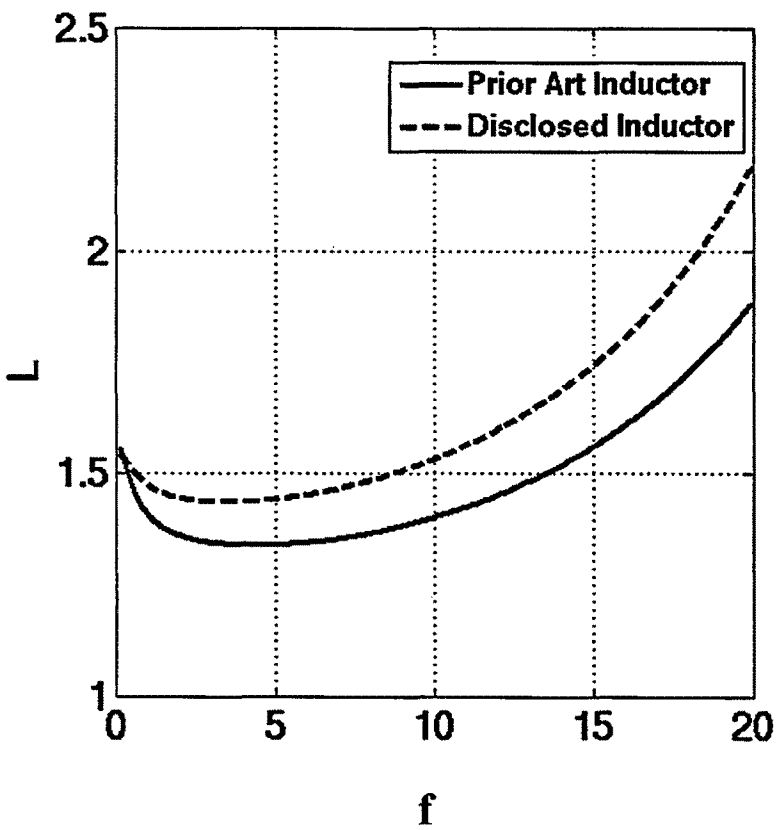
FIG. 6 depicts simulation results of inductance as a function of frequency, comparing a parallel stacked inductor of the present invention with that of a prior art inductor.

FIG. 6 depicts simulation results of inductance L (in nano-Henries) as a function of frequency (in GHz), comparing a parallel stacked inductor of the present invention with that of a prior art inductor. For this simulation, the prior art inductor had the following dimensions: 15μ (W)×5μ (S)×3.5 (N)×200μ (OD). The parallel stacked spiral inductor was dimensioned as follows: 11.5μ (W)×5μ (S)×2.75 (N)×200μ (OD).

The inductance as a function of frequency was found to be enhanced over a wide frequency spectrum, resulting in approximately an eight percent (8%) improvement.

Figure 7:
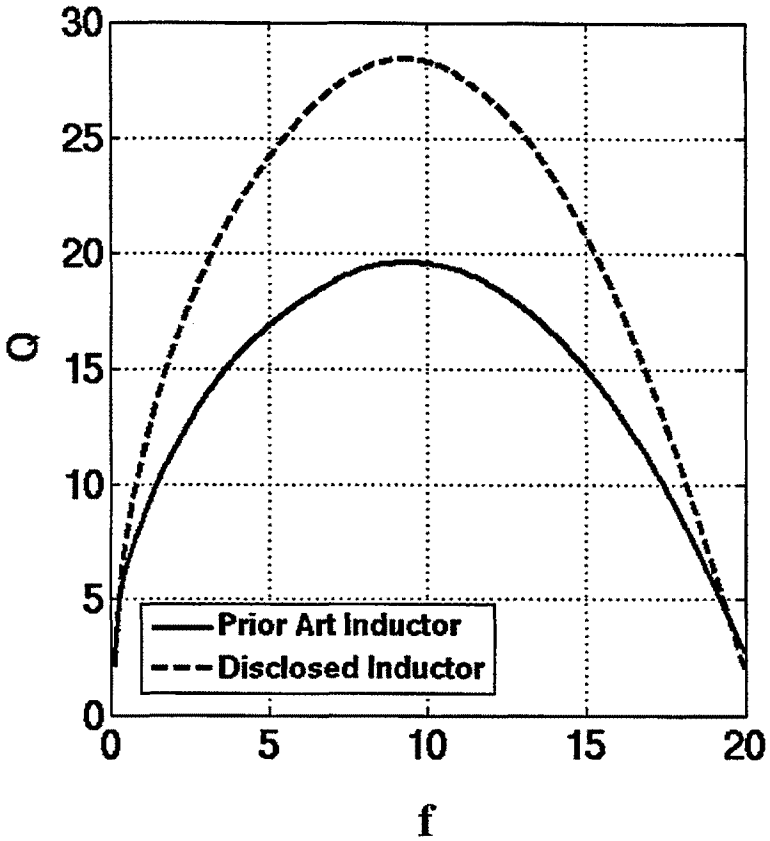
FIG. 7 depicts simulation results of Q-factor as a function of frequency for both a prior art design, and a parallel stacked inductor of the present invention.

FIG. 7 depicts simulation results of Q-factor as a function of frequency for both a prior art design, and a parallel stacked inductor of the present invention. As indicated, the Q-factor was enhanced significantly, on the order of forty three percent (43%).

Another advantage of the present design is the promotion of equal path length for the winding. This is possible because the winding is effectively shared across two current paths, where the outermost segment of one path of the winding is electrically connected to the innermost segment of the adjacent winding segment.

It is also noted that the lower metal layers may be tailored for high current handling by increasing the thickness and/or width as compared to the top metal layer. The increase in thickness and/or width of these lower metal layers may be localized in the bottom spiral(s), and gradually decrease in width of the spiral along each turn from the outermost turns to the innermost turns.

Furthermore, selective use of coolants and other thermal dissipation mechanisms 90 known in the art may be employed within or adjacent to the spiral winding segments that are more vulnerable than the others.

Magnetic materials may also be employed in the fabrication of the parallel stacked inductor.

Figure 8:
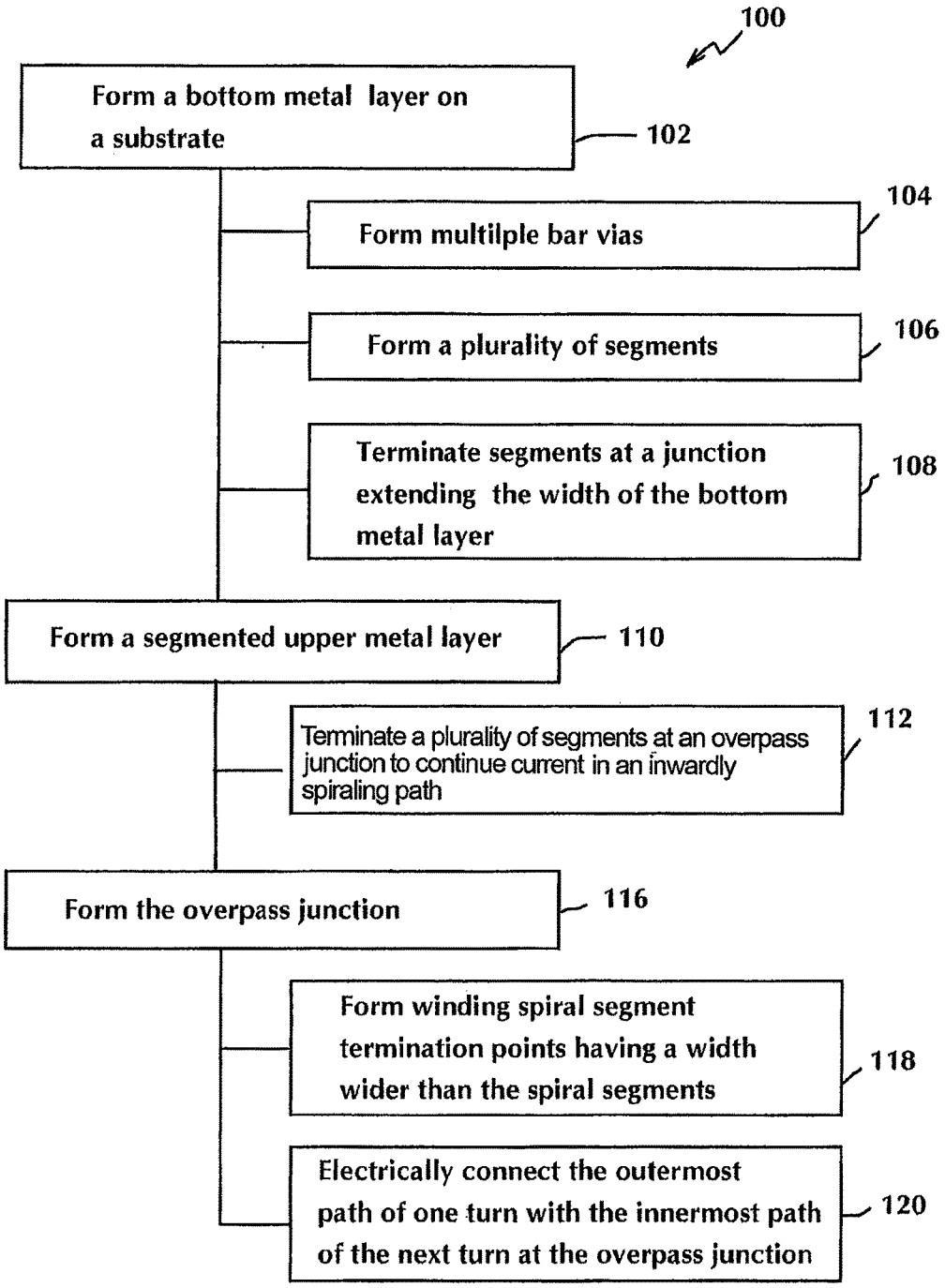
FIG. 8 depicts a flow chart of the method of forming a high-Q parallel stacked inductor of one embodiment of the present invention.

FIG. 8 depicts a method 100 for fabricating an embodiment described above for a high-Q parallel stacked inductor. The method includes the steps of forming lower and upper metal layers. A bottom metal layer is formed 102 by suitable process methods known in the art; the bottom metal layer includes the formation of multiple bar vias 104 traversing a plurality of segments 106, which carry current (spiraling inward). The bottom metal layer segments terminate at a junction that extends the width of the bottom metal layer 108. A segmented upper metal layer is formed 110 above the bottom metal layer, having a plurality of segments terminated at an overpass junction, and continuing the current carrying in an inwardly spiral fashion with other internally winding segments 112, with each segment terminating closer to the spiral center. An overpass junction is designed 116 at the winding spiral segments termination points having a width wider than the spiral segments 118. The winding spiral segments are preferably equidistant from one another. The overpass junction at each turn segment may electrically connect the outermost path of one turn with the innermost path of a next turn 120, which allows for equal current path length over the course of the winding. Bulges are formed in one layer where the winding segments are broken.

In addition, a method for generating the spiral turns with an arbitrary number of turns is taught. In a preferred embodiment, the number of bends at the $i^{th}$ spiral turn is equal to (i−1) if all the protrusions are inwards, and equal to (i−2) if the outermost turn protrudes outwards (for i>2).

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A parallel stacked inductor for an integrated circuit, said inductor comprising a plurality of metal layers each having a plurality of conductive spiral winding segments thereon, wherein the width and/or thickness of spiral winding segments on a top metal layer and/or spiral winding segments of a bottom metal layer are substantially constant and are increased only at locations where the respective spiral winding segments are broken for overpass connections.

2. The parallel stacked inductor of claim 1 wherein said plurality of spiral winding segments comprise multiple layers of parallel stacked conductive path segments.

3. The parallel stacked inductor of claim 1 wherein adjacent spiral winding segments of a top metal layer are joined using underpass and overpass connections without electrically shorting to respective conductive path segments.

4. The parallel stacked inductor of claim 1 wherein said top and bottom metal layers are connected through multiple segments of bar vias resulting in improved Q and current carrying.

5. The parallel stacked inductor of claim 3 wherein said underpass and/or overpass connections have a width wider than said plurality of spiral winding segments.

6. The parallel stacked inductor of claim 1 wherein the bottom metal layer includes wider track widths than said top metal layer to reduce series losses and increase current handling.

7. The parallel stacked inductor of claim 1 wherein multiple spiral winding segments of top and bottom spirals are interconnected in such a way that their electrical path lengths are approximately equal.

8. The parallel stacked inductor of claim 7 wherein outermost spiral winding segments of a first spiral turn are electrically connected to innermost spiral winding segments of a second spiral turn.

9. The parallel stacked inductor of claim 1 wherein said bottom metal layer comprises a continuous conductive path.

10. The parallel stacked inductor of claim 1 wherein at least one lower metal layer of said plurality of metal layers is tailored for high current handling, including having an increased thickness and/or width as compared to said top metal layer.

11. The parallel stacked inductor of claim 10 wherein said increased thickness and/or width is localized along said at least one lower metal layer of said plurality of metal layers such that a gradual decrease in said thickness and/or width is formed along at least one turn of said spiral winding segments.

12. The parallel stacked inductor of claim 1 including a thermal dissipation mechanism within or adjacent to at least one of said spiral winding segments which are more vulnerable to overheating.

* * * * *